US006099184A

United States Patent [19]

Koptis

[11] Patent Number: 6,099,184

[45] Date of Patent: Aug. 8, 2000

[54] DISPENSER-APPLICATOR ASSEMBLY

[75] Inventor: Kurt Koptis, Rancho Mirage, Calif.

[73] Assignee: Painter's Products, Inc., Palm Desert, Calif.

[21] Appl. No.: 09/071,619

[22] Filed: May 1, 1998

Related U.S. Application Data

[63] Continuation-in-part of application No. 08/856,282, May 14, 1997, abandoned.

[51] Int. Cl.[7] ..... B03C 17/005

[52] U.S. Cl. ..... 401/190; 401/206; 401/207; 401/266

[58] Field of Search ..... 401/190, 139, 401/266, 205, 207, 206, 202

[56] References Cited

U.S. PATENT DOCUMENTS

| | | | |
|---|---|---|---|
| 2,897,526 | 8/1959 | Dootson | 401/266 |
| 3,137,885 | 6/1964 | Hulsh | 401/190 X |
| 3,184,781 | 5/1965 | Hoxie | 401/190 X |
| 3,981,597 | 9/1976 | Cohn | 401/270 X |
| 4,250,586 | 2/1981 | Timian | 401/207 X |
| 4,611,941 | 9/1986 | Karliner et al. | 401/207 |
| 4,822,194 | 4/1989 | Simonette | 401/207 |
| 4,969,854 | 11/1990 | Katsuda et al. | 401/190 |
| 5,271,533 | 12/1993 | Joulia | 401/190 X |
| 5,567,073 | 10/1996 | De Laforcade et al. | 401/190 |

FOREIGN PATENT DOCUMENTS

| | | | |
|---|---|---|---|
| 1151152 | 1/1958 | France | 401/207 |
| 2919 | 2/1967 | Japan | 401/190 |
| 466176 | 1/1969 | Switzerland | 401/190 |
| 999593 | 7/1965 | United Kingdom . | |
| 2198035 | 6/1988 | United Kingdom | 401/190 |

*Primary Examiner*—David J. Walczak
*Assistant Examiner*—Kathleen J. Prunner
*Attorney, Agent, or Firm*—Milton M. Field

[57] ABSTRACT

A dispenser-applicator assembly mounted on an aerosol container dispenses and applies a stain to a work surface. The assembly has two integral parts: a dispenser and a porous applicator. The dispenser is molded as one piece of polypropylene and includes a cap-shaped body which is truncated by a support panel. An actuator panel is hinged to the rear side of the support panel, by means of a flexible dispensing tube which has a horizontal portion and a vertical end portion aligned with a vertical valve stem of the aerosol container. The dispensing tube has a passageway extending to a dispensing opening through the support panel. When the activator panel is depressed, the vertical end of the dispensing tube is lowered to engage the valve stem to open the valve and dispense stain through the passageway and the dispensing opening. The porous applicator is adhesively mounted on the support panel. To avoid oversaturation and dripping from the outer edges of the porous applicator, a tapered liquid reservoir recess is provided on the front face of the support panel adjacent the central portion of the applicator. The recess is closed by a ledge. If the applicator becomes too saturated, auxiliary recesses on the opposite side of the ledge collect the excess liquid. The outer edges of the applicator extend beyond the edges of the support panel enabling the application of stain to corner and edge areas of the work. Slits extend through the applicator to enhance liquid transfer to the work surface.

18 Claims, 6 Drawing Sheets

DISPENSER-APPLICATOR ASSEMBLY

This application is a continuation-in-part of my application Ser. No. 08/856,282 filed May 14, 1997, now abandoned.

BACKGROUND OF THE INVENTION

1. Field of the Invention

This invention relates to dispenser-applicator assemblies and, more particularly, to dispenser-applicator assemblies for dispensing and applying a liquid dispensed from an aerosol container.

2. Description of the Prior Art

Aerosol containers, which are filled with a liquid and a gas under pressure to aerate and dispense the liquid through a valve, are widely used. There have been a number of suggestions of attachments to such containers to enhance their utility for applying the liquid to a work surface. In the aerosol upholstery shampooer shown in Hoxie U.S. Pat. No. 3,184,781, for example, a dispenser-applicator is attached to an aerosol can by means of a special separate threaded adaptor which is snapped in place on the can. After the dispenser-applicator is screwed onto the adaptor, a trigger is depressed to actuate the valve and dispense the liquid through a passageway to an applicator member which includes a sponge block surrounded by bristles. However, Hoxie's dispenser-applicator, having several parts, is relatively expensive to produce. Moreover, the liquid is fed directly to a single point on the sponge block, and being unable to stay there, is deflected laterally spreading quickly to the outer edges of the block. The outer edges rapidly become over saturated, causing dripping of the liquid, frequently on a hand of the user.

Cohn U.S. Pat. No. 3,981,597 shows a shaving cream dispenser having a housing which snaps onto an aerosol can. The housing includes a tube which seats on the valve of the aerosol can and extends laterally to deliver shaving cream to brush bristles. The tube is integral with an actuating platform for which the tube serves as a hinge. Depression of the platform causes shaving cream to be delivered to the bristles. While the bristles are suitable for applying shaving cream to the user's face, it is not effective for applying a stain or paint to a work surface.

Drake U.S. Pat. No. 4,636,102 also discloses a snap-on cap for dispensing shaving cream to a brush and also includes a tube which serves as a hinge for the applicator panel.

Samaras et al. U.S. Pat. No. 3,164,856 also shows a dispenser for feeding a liquid to a brush from a pressurized can. In one embodiment, a sponge pad, which extends laterally beyond the edges of the support base, is substituted for the brush. A recess is shown beneath the sponge pad, but its structure and functions are not described.

British Patent No. 2,198,035A discloses a writing or painting instrument which dispenses a liquid from a pressurized container. The passageway for the liquid empties into a recess provided beneath a writing portion, which comprises an expanded sponge layer beneath an open-cell sponge layer. Ribs extend from a cover and seem to provide additional recesses. However, the structure and functions are not described; and it is not explained whether the additional recesses are separate from or are connected to the main recess or whether the ribs have any function beyond serving as a mounting structure for the writing portion. Because the expanded sponge layer is not porous one or more thin through-holes, having a diameter of about 2 mm., extend through the writing portion. It is said that the through-holes should not be too thin because they become clogged. The writing portion may be formed of a single open cell sponge layer in which case the through-holes may not be necessary.

Swiss Patent No. 446,176 also discloses an aerosol dispenser. A passageway feeds a liquid to a central recess beneath a sponge applicator. In one embodiment, a bore hole is provided through the center of the sponge applicator.

Katsuda et al. U.S. Pat. No. 4,969,854 shows an aerosol applicator having a cap for feeding liquid to a vertical applicator which extends the entire height of the aerosol container and cap. Liquid is fed to a flow space which extends behind the entire length of the applicator.

While a number of other devices for the application of liquid from a pressurized can are shown in U.S. Pat. Nos. 4,089,609; 3,256,549; 3,814,525; 2,900,651; and 3,231,923, more effective distribution of the liquid is desirable.

An applicator with a flocked fabric surface has been used for the smooth application of a liquid to a work surface. Typically, the flocked fabric surface is dipped in liquid in an open container. If the flocked fabric were to be glued to a porous applicator receiving the liquid from a pressurized container, the glue would block the flow of the liquid to the fabric.

SUMMARY OF THE INVENTION

Accordingly, a is the object of this invention to provide improved dispenser-applicator assemblies for attachment to an aerosol container.

More particularly, it is an object of the invention to provide dispenser-applicator assemblies which are simple in construction and easily assembled and which consist of only two integral parts.

A further object of the invention concerns the provision of a more efficient structure for the delivery and control of the liquid to the applicator member.

Another object involves the provision of means to prevent dripping caused by excessive saturation of the outer edges of the applicator member.

Still another object relates to an embodiment of the applicator member which is modified to dispense liquid more efficiently.

More specifically, a dispenser-applicator assembly of this invention consists of two integral parts: dispenser means and a porous applicator member. The dispenser means includes a cap-like generally cylindrical structure having a mounting skirt for mounting the dispenser means on an aerosol container. The cap-like support structure is truncated at one side by a generally planar support panel. A flexible tube has a horizontal portion cantilevered from the rear side of the support panel and a vertical portion at the distal end of the horizontal portion, which vertical end portion, when the assembly is mounted on an aerosol container, is vertically aligned with the container valve stem. A horizontal activator panel is mounted on, and integral with, the horizontal portion of the flexible tube, which, being flexible, acts as hinge means for the activator panel. When a user presses the activator panel, the panel is pivoted about the hinge formed by the cantilever connection of the proximate end of the horizontal portion of the flexible tube with the rear side of the support panel; and the vertical end portion of the flexible tube is lowered into the valve stem to open the valve and dispense the liquid through the flexible tube. Liquid is dispensed through an opening aligned with the proximate end of the horizontal portion and extending through the support panel to its front side. The porous applicator member is mounted on and over the front side of the support panel and receives the liquid dispensed through the opening.

It has been found empirically that the problem of dripping liquid at the edges of the applicator is substantially alleviated by providing a liquid reservoir recess on the front face of the support panel behind the central portion of the applicator member. The reservoir recess temporarily stores the liquid adjacent, and behind, the central portion of the applicator member. This tends to insure that the central portion is adequately saturated with the liquid, while the flow of liquid is controlled to avoid excess saturation, and dripping at the outer edges of the applicator member. It has also been found empirically that this control of the liquid flow to the outer edges of the applicator member is greatly enhanced by tapering the depth of the reservoir recess so that it has its deepest end adjacent the opening receiving the liquid from the flexible tube. In order to force the liquid into the tapered recess, a ledge or ridge extends across the support panel at the deepest end of the recess. Liquid is thus stored and concentrated adjacent the central portion of the porous applicator member; and the greatest concentration of the liquid is at the deepest part of the recess adjacent the opening receiving the liquid and the ledge. In case too much liquid is absorbed by the porous applicator member, three auxiliary tapered reservoir recesses are provided on the support panel on the other side of the ledge. These auxiliary reservoir recesses are deepest at the end adjacent the ledge. This provides additional recesses at the central portion of the porous applicator in which the excess liquid may be stored. It has been found empirically that this further enhances the performance of the applicator in reducing the problem of dripping.

One embodiment of the porous applicator member comprises a block of porous sponge, a flat wall of which faces and receives liquid from the liquid reservoir recesses. In order to provide easy access to corner and edge areas of a work surface, the outer edges of the porous applicator member extend beyond the edges of the support panel.

A second, and preferred embodiment, of the porous applicator member comprises a block of porous sponge of the same dimensions as the sponge of the first embodiment. For engaging the work surface, the sponge has a flocked, or brush, surface on the outer side of the porous sponge. This flocked surface is provided on the outer side of a flocked fabric which is adhesively secured to the outer side of the porous sponge.

In order to enhance the efficiency of the transfer of liquid from the liquid reservoir recess through the sponge, the glue securing the flocked fabric to the sponge, and flocked fabric, a number of parallel slits are cut through the sponge and flocked fabric. These may be confined to the central portion of the applicator member, but may extend over a larger portion of the member.

The device of the invention is of particular utility for dispensing and applying a stain. However, it will be understood, that it also may be used to dispense and apply other liquids, such as paint, wax, and detergents.

BRIEF DESCRIPTION OF THE DRAWINGS

A clearer understanding of the present invention will be apparent from the following description and drawings, wherein.

DETAILED DESCRIPTION

Figure 5:
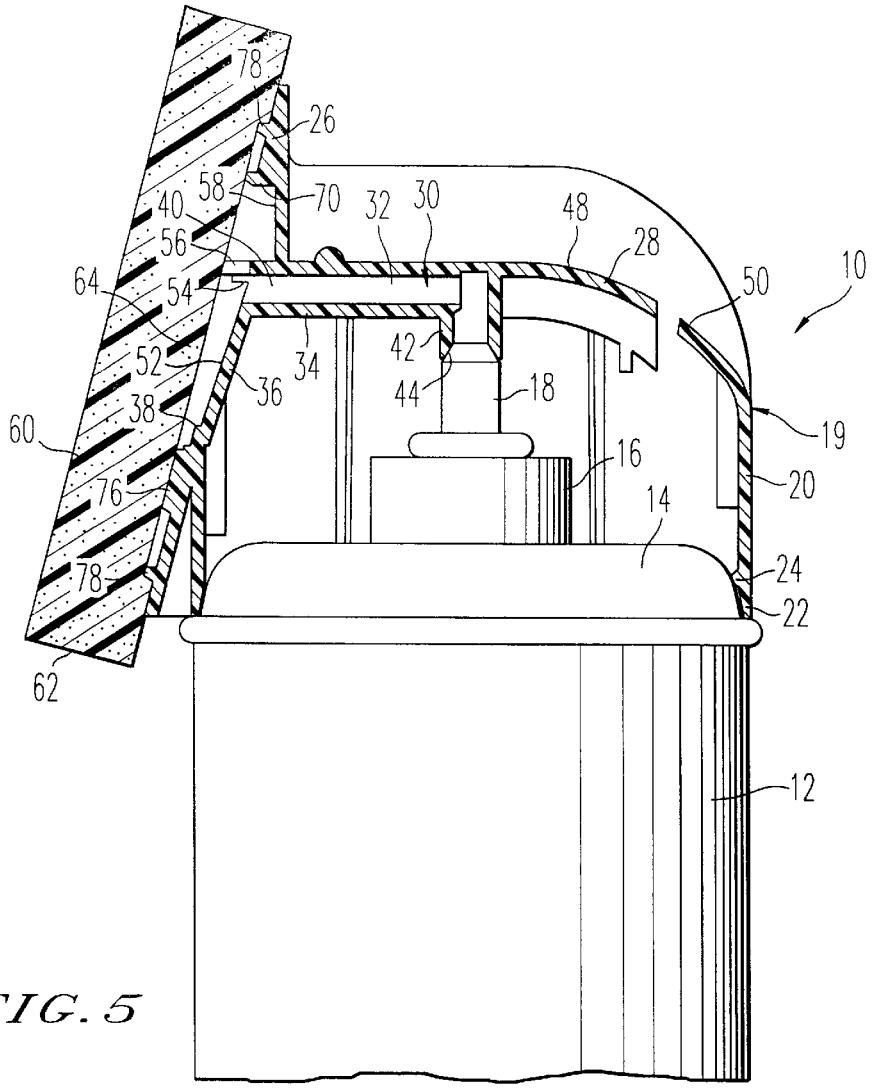
FIG. 5 is a view of the assembly of FIG. 1, in a sectional view corresponding to the view of FIG. 3, mounted on an aerosol container.

In FIG. 5, a dispenser-applicator assembly 10 of the invention is shown mounted on an aerosol container 12. As is well-known, container 12 is pressurized and is filled with an aerosol mixture of a liquid to be dispensed, such as a stain solution, and a propelling gas. Container 12 has a closure top 14 and has a suitable valve 16 with a vertical tubular delivery member 18 serving as the valve actuating stem. A spring biases a valve member on stem 18 upwardly to a closed position. In order to open the valve, downward pressure is applied to stem 18 overcoming the spring and the internal pressure in container 12 to open valve 16. As a result, the aerosol mixture escapes through hollow stem 18.

Figure 6:
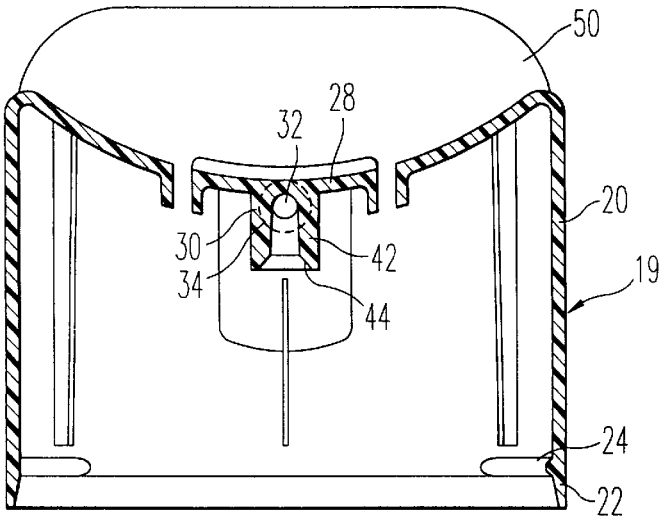
FIG. 6 is a section view along line 6—6 of FIG. 1.

Assembly 10, includes a dispenser 19 having a cap-shaped support structure 20 from which a mounting skirt 22 depends. In order to provide for a snug fit of assembly 10 on container 12, a plurality of raised ridges 24 are provided on the inner surface of skirt 22 as shown in FIGS. 3, 5 and 6.

Figure 1:
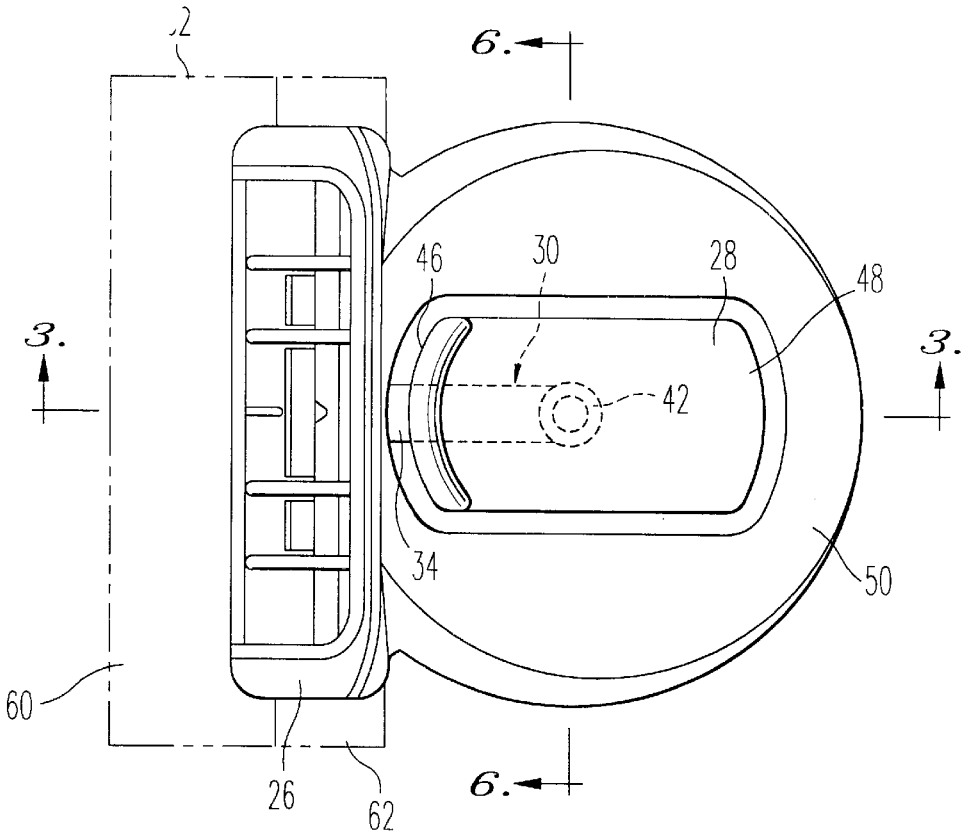
FIG. 1 is a top view of a dispenser-applicator assembly of the invention with the applicator member shown in phantom line.
Figure 2:
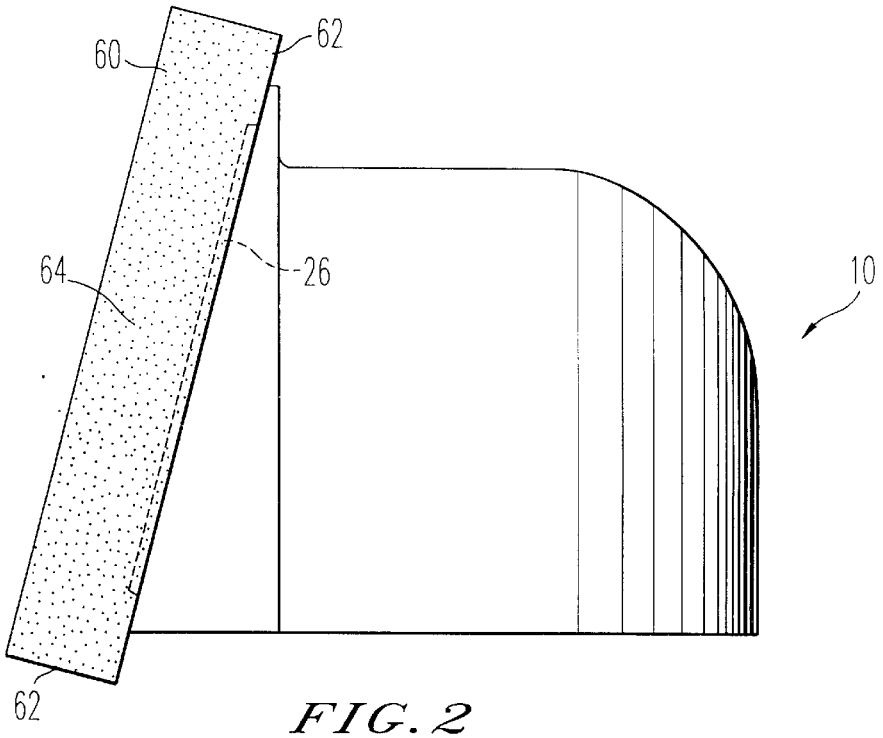
FIG. 2 is a side elevation of the assembly of FIG. 1.

Cap-shaped structure 20 is generally cylindrical, but is truncated at one side by a generally planar support panel 26. As best seen in FIGS. 2, 3 and 5, panel 26 is tipped at an angle of fifteen degrees with respect to vertical axis 27 of cap-shaped structure 20. So that the user may conveniently control valve 16 on aerosol container 12, a horizontal activator panel 28 is provided as shown in FIGS. 1, 3, 4, 5, 6, 8, and 9. As will be presently described, flexible hinge means is provided to hinge activator panel 28 on cap-shaped support structure 20.

A flexible dispensing tube 30 provides a passageway 32 to convey the liquid dispensed from valve stem 18 to applicator support panel 26. Tube 30 includes a horizontal portion 34 which is cantilevered from the rear surface 36 of support panel 26. To convey liquid to the front side 38 of panel 26, a dispensing opening 40 extends through panel 26. The distal end of horizontal tube portion 34 is terminated by a vertical tube section 42. When dispenser-applicator assembly 10 is mounted on aerosol container 12, as seen in FIG. 5, vertical tube section 42 aligns passageway 32 with valve stem 18 of the aerosol container. The bottom beveled end 44 of vertical tube portion 42 may just barely touch or be slightly spaced above valve stem 18.

Figure 3:
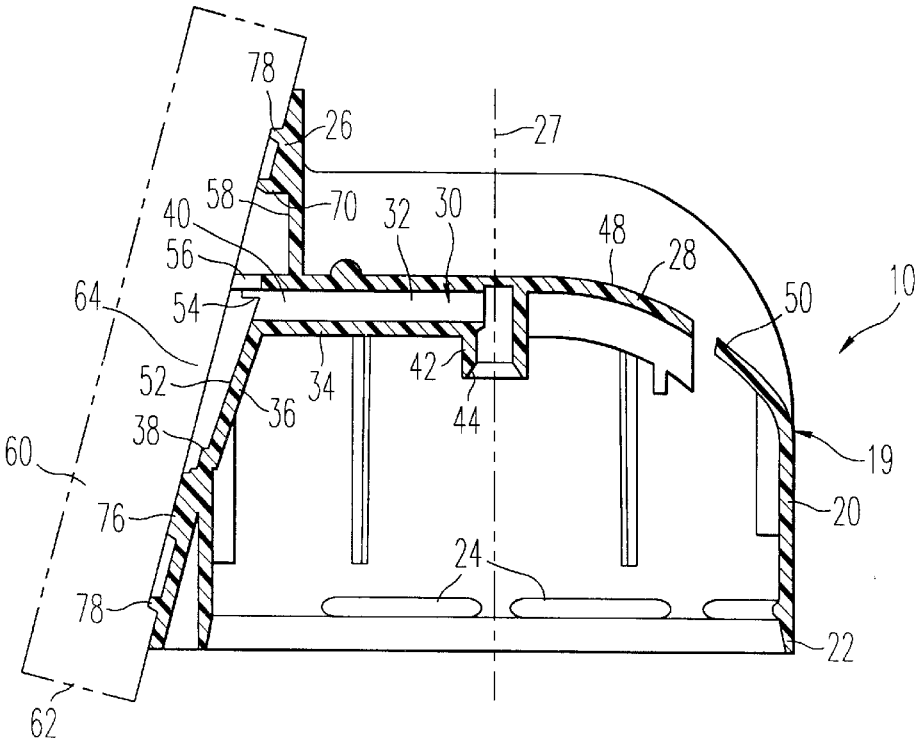
FIG. 3 is a section view along the line 3—3 of the assembly of FIG. 1.
Figure 4:
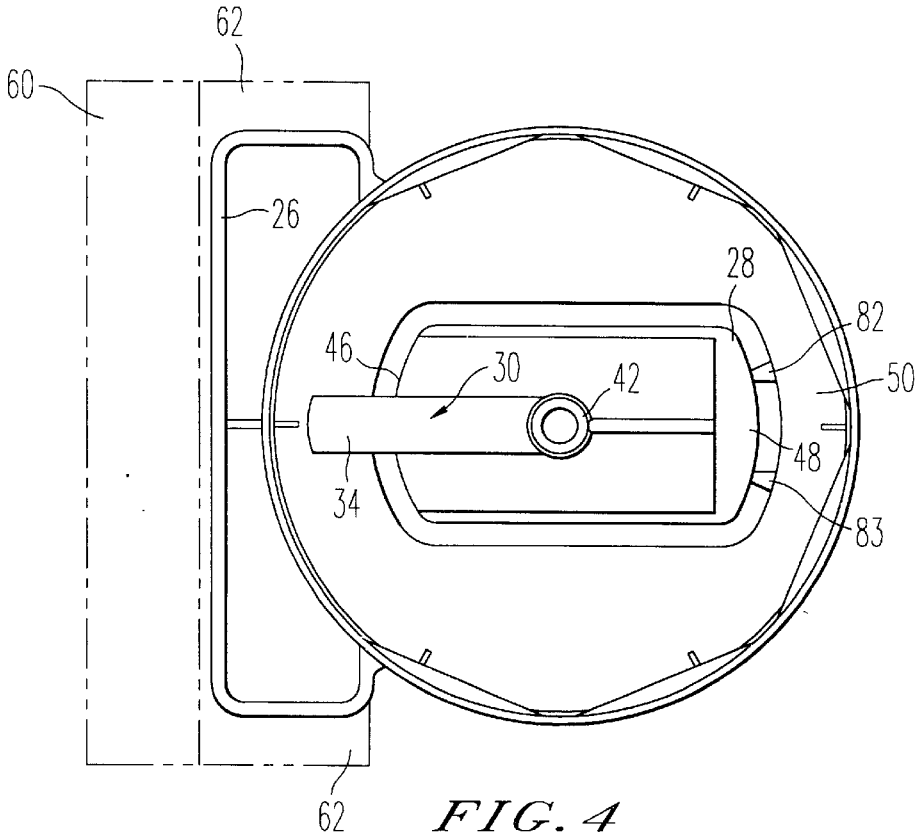
FIG. 4 is a bottom view of the assembly of FIG. 1 with the first embodiment of the applicator member shown in phantom line.

It will be observed from FIGS. 3 and 5, that horizontal activator panel 28 is integral with part of the top wall of horizontal tube section 34. As seen in FIGS. 1 and 4, horizontal activator panel 28 is wider than horizontal tube portion 34, has a stiffening ridge 46 spaced from rear surface 36 of support panel 26, and has a portion 48 extending beyond vertical tube section 42, but short of a top surface 50 of cap-shaped support structure 20. By virtue of the flexibility of horizontal tube portion 34, it will flex and serve as the hinge means for horizontal activator panel 28 when a user presses panel 28.

A porous applicator member 60, which, in a first embodiment, comprises a sponge block, is mounted by means of an adhesive on support panel 26. The liquid dispensed through opening 40 is absorbed by porous applicator member 60. It has been found, however, in the absence of the improvements of the present invention, that the liquid is not adequately controlled in porous applicator member 60. The liquid spreads too quickly laterally through porous member 60 causing oversaturation of, and dripping from, its outer edges 62.

Figure 7:
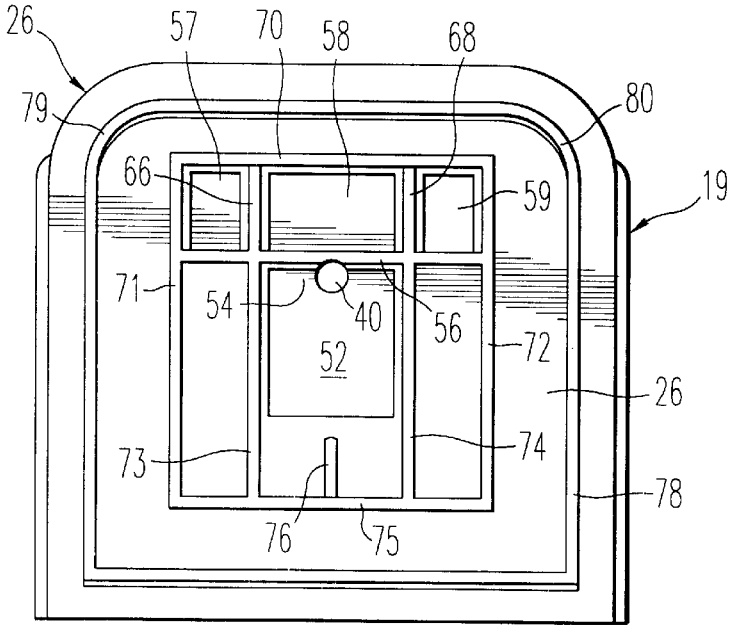
FIG. 7 is a front elevation view of the dispenser of the assembly of FIG. 1 with the applicator member removed.
Figure 8:
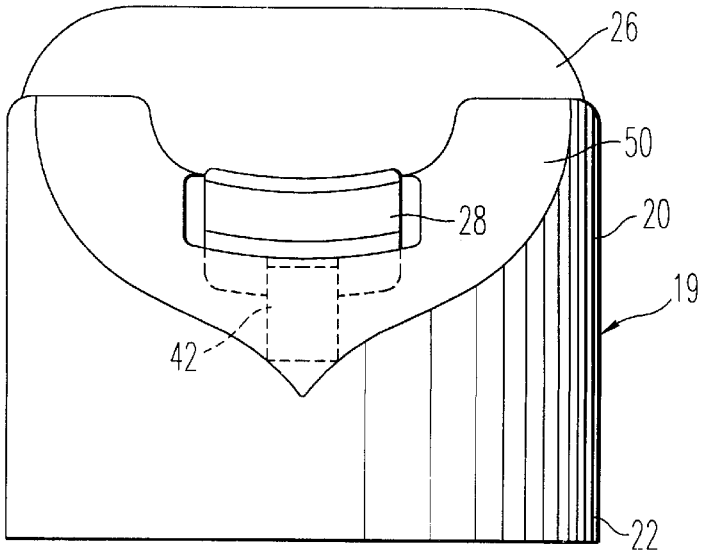
FIG. 8 is a rear elevation view of the dispenser of the assembly of FIG. 1 with the applicator member removed.
Figure 9:
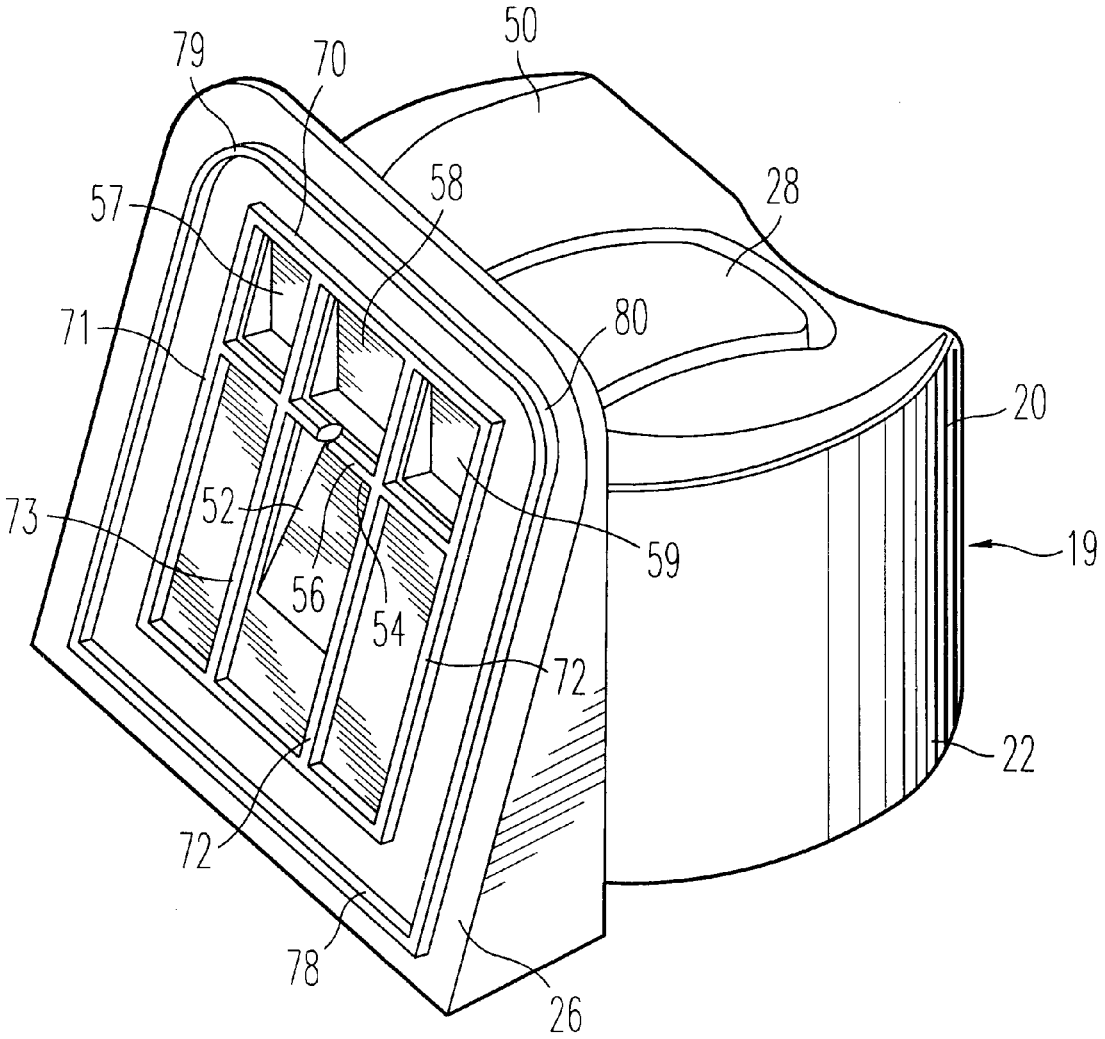
FIG. 9 is a perspective view of the dispenser of the assembly of FIG. 1 with the applicator member removed.

As seen in FIGS. 7 and 9, this problem is avoided by providing a liquid reservoir recess 52. This recess is located behind the central portion 64 (see FIGS. 3 and 5) of applicator member 60. Recess 52 is tapered in that it is deepest at the end 54 at which it communicates with dispensing opening 40. The deepest end 54 is adjacent a ledge or barrier 56 which forces liquid from dispensing opening 40 into recess 52. By this construction, liquid dispensed through opening 40 is collected and stored in recess 52. This keeps the liquid from moving too quickly to the outer edges 62 of applicator member 60 while providing adequate saturation of central portion 64. In the event that applicator member 60 becomes oversaturated, auxiliary tapered reservoir recesses 57, 58 and 59 are provided to store excess liquid and keep it localized adjacent the central portion 64 of applicator 60. These auxiliary recesses are also behind central portion 64 of porous applicator 60.

As seen in FIGS. 7 and 9, auxiliary recesses 57, 58 and 59 are positioned on the side of ledge 56 opposite to liquid reservoir recess 52 and are arranged in a row. The sectional views of FIGS. 3 and 5 show that recesses 57, 58 and 59 are also tapered in depth, being deepest at the end adjacent to ledge 56. Ledges 66 and 68 perpendicular to ledge 56 separate auxiliary recesses 57, 58 and 59. A further ledge 70 is parallel to ledge 56 and closes the opposite ends of recesses 57, 58 and 59. Side ledges 71 and 72 complete the borders to recesses 57 and 59, respectively. Ledges 73 and 74 are aligned with ledges 66 and 68, and ledge 75 closes the rectangle formed by outer ledges 70, 71 and 72. A ledge 76 is aligned with dispensing opening 40 and extends towards opening 40 from ledge 75, stopping short of reservoir recess 52. An outer ledge 78 encloses the edge rectangle and has arcuate corners 79 and 80 at the upper end of support panel 26 as seen in FIG. 7.

It will be observed that the tops of all of the aforementioned ledges fall in the same plane and act as a support structure for porous applicator member 60 which is adhesively secured thereon. As shown in FIG. 4, porous applicator member 60 is rectangular and has its outer edges 62 extending beyond the outer edges of support panel 26. This enables porous applicator member 60 to be used for easily applying stain to corner and edge areas of the work.

As has been mentioned, dispenser 19 is molded of polypropylene as an integral member. When it is formed, frangible tabs 82 and 83 (see FIG. 4) connect end 48 of horizontal activator panel 28 to cover portion 50 of support structure 20. These tabs prevent accidental actuation of valve 16 of aerosol container 12 after assembly 10 is mounted thereon. When the user is ready to use the assembly, tabs 82 and 83 are easily broken by prying panel 28 upwardly.

After assembly 10 has been mounted on an aerosol container 12, the user dispenses stain by depressing activator panel 28. This moves vertical end 42 of flexible tube 30 into engagement with valve stem 18 depressing valve stem 18 to open valve 16. This causes the liquid stain and propellant gas within container 12 to begin to flow through valve stem 18, vertical end 42, tubular passageway 32 and dispensing opening 40. The liquid stain then, in part, adequately saturates central portion 64 with the remainder of the stain collected and stored in liquid reservoir recess 52. When the user then applies the porous applicator member 60 upon the work to be stained, the stain flows from reservoir recess 52 through the porous applicator member to the work. Because the stain does not excessively saturate the outer edges 62, dripping is avoided. If porous applicator member 60 becomes oversaturated, the excess liquid stain collects in auxiliary recesses 57, 58 and 59 and dripping is again avoided.

Figure 10:
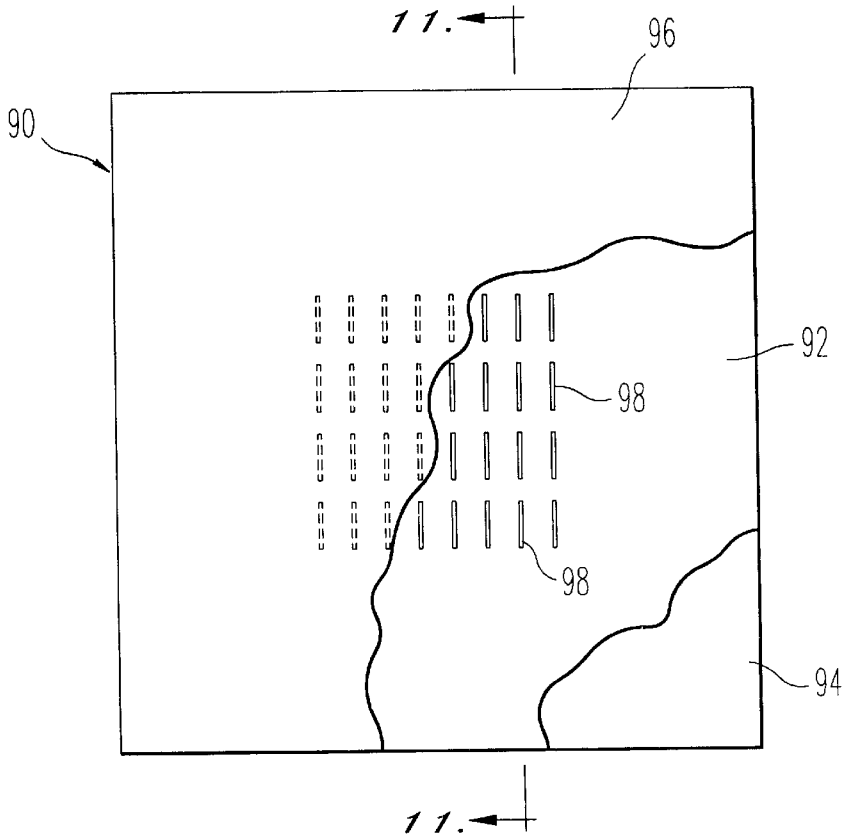
FIG. 10 is a plan view of the second embodiment of applicator member with layers partially broken away.
Figure 11:
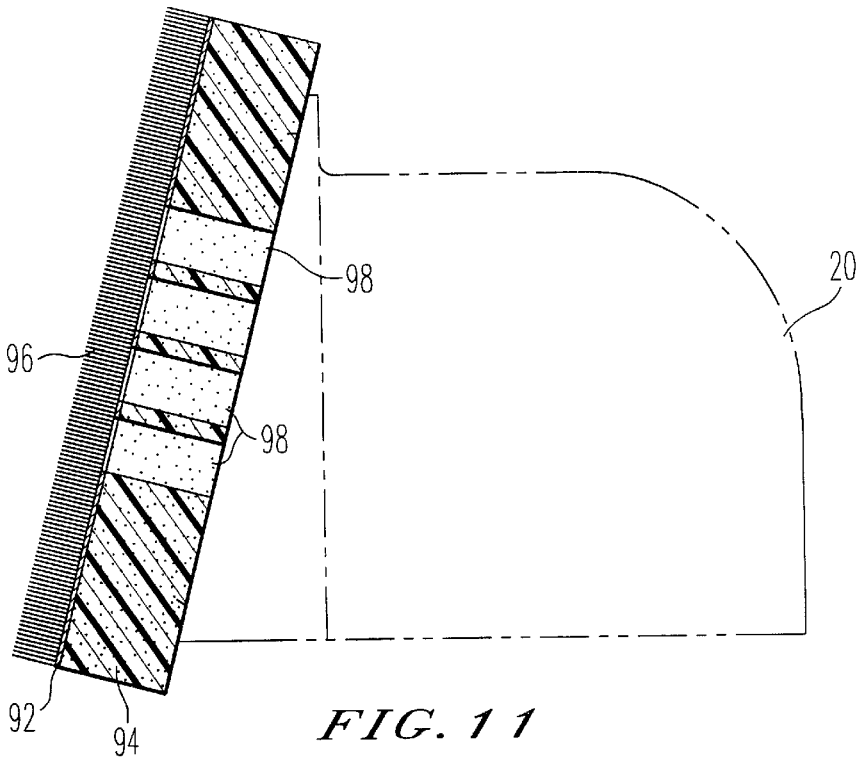
FIG. 11 is a side elevation with the dispenser shown in phantom line and the applicator of FIG. 10 mounted thereon and shown in cross-section along the line 11—11 of FIG. 10.

A second, and preferred, embodiment of the applicator member is shown in FIGS. 10 and 11. As seen in FIG. 11, a flocked surface is provided on the outer surface of applicator member 90 by gluing a flocked fabric 92 on the outer surface of a block of porous sponge 94 with the flocking 96 projecting from the outer surface of fabric 92. The flocking provides a brush-like surface for smoother application of the liquid to the work.

In order to apply the liquid more efficiently through applicator member 90, as shown in FIG. 10, a plurality of spaced parallel slits 98 are cut through applicator member 90. These slits 98 extend through fabric 92, through the glue securing fabric 92 to sponge 94, and through the corresponding locations on porous sponge 94. As shown in FIG. 10, slits 98 may be confined to central portion 64 of applicator member 90. As has been pointed out above, central portion 64 extends over reservoirs 52, 57, 58 and 69. However, it is to be understood that slits 98 may also be provided through other portions of applicator member 90. While slits 98 are shown extending in one direction in FIG. 10, it is to be understood that they may extend in another direction, such as perpendicular to the direction shown in FIG. 10.

Although the dispenser-applicator assembly of the invention has been described with particular reference to the dispensing and application of a stain to the work, it will be understood that the device of the invention is also particularly useful for applying paints, waxes and detergents. However, it will be recognized that it will also be useful for the application of a wide variety of liquids from an aerosol container.

Although the invention has been described with reference to particular embodiments, it is to be appreciated that various adaptations and modifications may be made within the spirit of the invention.

The invention claimed is:

1. A dispenser-applicator assembly for dispensing a liquid from an aerosol container having valve means, comprising:

dispenser means including a cap structure;

mounting means on said cap structure for mounting said assembly on said container;

an activator panel;

means for hinging said activator panel on said cap structure;

flexible tube means with one end aligned with said valve means, when said assembly is mounted on said container, said flexible tube means being connected to said activator panel so that when a user presses said activator panel, said flexible tube means is pushed into said valve means to open said valve means to dispense said liquid through said flexible tube means; and an applicator support panel, comprising means including an opening for receiving said liquid from said flexible tube means, a liquid reservoir recess for storing said liquid and having an open side, said recess being tapered in depth with said opening being located at the deepest portion of said recess, ledge means extending across said panel adjacent said deepest portion of said recess whereby one side of said ledge means forces said liquid into said recess, and means for mounting a porous applicator member on said support panel over said open side of said liquid reservoir recess, said applicator member having a central portion and outer edges, said reservoir recess being directly behind and closed by said central portion when said porous applicator member is mounted on said support panel, whereby said porous applicator member receives liquid from said recess in said central portion and is adequately saturated with said liquid in said central portion without excessive saturation of said outer edges to reduce dripping.

2. An assembly of claim 1, wherein auxiliary reservoir recess means having an open side facing said porous applicator member, when said member is mounted on said support panel, is located on said support panel on the opposite side of said ledge means to keep excess liquid in the central portion of said porous applicator member.

3. An assembly of claim 2, wherein said auxiliary reservoir recess means comprises three liquid reservoir recesses on said opposite side of said ledge means, said three liquid reservoir recesses being aligned in a row parallel to said ledge means.

4. An assembly of claim 3, wherein said auxiliary reservoir recesses are tapered in depth with the deepest portion of said recesses being adjacent said ledge means.

5. An assembly of claim 1, wherein said flexible tube means comprises a vertical section including said one end aligned with said valve means and a horizontal section aligned with said means for receiving said liquid from said flexible tube means.

6. An assembly of claim 5, wherein said activator panel is horizontal and has a portion contiguous and connected to said horizontal section of said flexible tube means.

7. An assembly of claim 5, wherein said horizontal section is cantilevered from said support panel, said activator panel is horizontal, spaced from said support panel, and mounted on said horizontal section, and wherein said horizontal section comprises said means hinging said activator panel.

8. An assembly of claim 7, wherein said activator panel is contiguous and integral with said horizontal section.

9. An assembly of claim 1, wherein said dispenser means is molded as an integral unit.

10. An assembly of claim 1, wherein said porous applicator member is mounted on said support panel, and wherein a plurality of slits are cut through said porous applicator member to enhance the transfer of said liquid through said porous applicator member.

11. The assembly of claim 10, wherein said porous applicator member comprises a block of sponge-like material and a flocked fabric secured to the outer surface of said block of sponge-like material, said flocked fabric having a flocked surface on its outer surface, said slits extending through both said flocked fabric and said block of sponge-like material.

12. The assembly of claim 10, wherein said slits are parallel to one another.

13. The assembly of claim 10, wherein said slits are located in said central portion of said porous applicator member.

14. A dispenser-applicator assembly for dispensing a liquid from an aerosol container having valve means, comprising:

dispensing means;

means for mounting said dispensing means on said container;

said dispensing means comprising actuator means for opening said valve means and conduit means for conveying liquid from said container when said valve means is open; and applicator support means including an opening for receiving said liquid from said conduit means, a liquid reservoir recess receiving said liquid from said opening for storing said liquid and having an open side, and auxiliary reservoir recess means having an open side and positioned adjacent to and in noncommunication with said reservoir recess so that both said recess and said auxiliary reservoir recess means are arranged side by side, and means for mounting a porous applicator on said applicator support means over said open side of said liquid reservoir recess and said auxiliary reservoir recess means, said porous applicator having a central portion and outer edges, said reservoir recess and said auxiliary reservoir recess means being directly behind and closed by said central portion when said porous applicator is mounted on said applicator support means, whereby said porous applicator receives liquid from said reservoir recess in said central portion, said auxiliary reservoir recess means receiving excess liquid from said porous applicator, and said porous applicator is adequately saturated with said liquid in said central potion without excessive saturation of said outer edges to reduce dripping.

15. A dispenser-applicator assembly for dispensing a liquid from an aerosol container having valve means, comprising:

dispensing means;

means for mounting said means on said container;

said dispensing means comprising actuator means for opening said valve means and conduit means for conveying liquid from said container when said valve means is open; and applicator support means including an opening for receiving said liquid from said conduit means, a liquid reservoir recess receiving said liquid from said opening for storing said liquid and having an open side, said recess being tapered in depth with said opening being located at the deepest portion of said recess, auxiliary reservoir recess means having an open side, and means for mounting a porous applicator on said applicator support means over said open side of said liquid reservoir recess and said open side of said auxiliary reservoir recess means, said porous applicator having a central portion and outer edges, said reservoir recess and said auxiliary reservoir recess means being directly behind and closed by said central portion when said porous applicator is mounted on said applicator support means, whereby said porous applicator receives liquid from said reservoir recess in said central portion, said auxiliary reservoir recess means receiving excess liquid from said porous applicator, and said porous applicator is adequately saturated with said liquid in said central portion without excessive saturation of said outer edges to reduce dripping.

16. An assembly of claim 15, wherein said porous applicator has a plurality of slits extending therethrough to enhance the transfer of said liquid through said porous applicator.

17. An assembly of claim 16, wherein said slits are parallel to one another.

18. An assembly of claim 16, wherein said slits are located in said central portion of said porous applicator.

* * * * *